United States Patent [19]

Hay, II et al.

[11] 4,234,447

[45] Nov. 18, 1980

[54] MIXING METHOD AND CONTAINER THEREFOR

[75] Inventors: Robert A. Hay, II; Harold E. St. Louis, both of Midland, Mich.

[73] Assignee: The Dow Chemical Company, Midland, Mich.

[21] Appl. No.: 925,016

[22] Filed: Jul. 17, 1978

[51] Int. Cl.[2] ..... G21F 9/16; G21F 5/00

[52] U.S. Cl. ..... 252/301.1 W; 141/339; 141/372; 141/390; 206/219; 220/85 F; 220/361; 220/363; 220/DIG. 21; 250/506; 250/507; 250/517; 366/347; 366/244; 366/245; 366/249; 422/159

[58] Field of Search ..... 252/301.1 W; 250/506, 250/507, 517; 366/347, 244, 245, 249; 220/361, 363, DIG. 21, 85 F, 229, 359; 141/339, 372, 390, 252; 422/159; 206/219

[56] References Cited

U.S. PATENT DOCUMENTS

| | | | |
|---|---|---|---|
| 2,629,534 | 2/1953 | Reynolds | 220/359 |
| 3,292,912 | 12/1966 | Stubler | 366/347 |
| 3,739,936 | 6/1973 | Jones | 220/229 |
| 4,016,096 | 4/1977 | Meyer | 252/301.1 W |
| 4,037,754 | 7/1977 | Wilhelmi et al. | 220/229 |
| 4,056,362 | 11/1977 | Gablin et al. | 252/301.1 W |

FOREIGN PATENT DOCUMENTS

| | | | |
|---|---|---|---|
| 2421142 | 11/1975 | Fed. Rep. of Germany | 250/517 |

*Primary Examiner*—Benjamin R. Padgett
*Assistant Examiner*—Deborah L. Kyle
*Attorney, Agent, or Firm*—R. B. Ingraham

[57] ABSTRACT

In a process for the admixture of radio-active waste with an encapsulating resin in a container which will accompany the waste to a disposal site, the improvement which comprises providing a generally annular deflectable foil at an upper open end of the container to minimize contamination by splashing.

8 Claims, 3 Drawing Figures

MIXING METHOD AND CONTAINER THEREFOR

In the disposal of low-level radio-active wastes, particularly those in aqueous form, it is often desirable to encapsulate the wastes within a resinous or resin matrix, causing the matrix to harden after the mixture is placed in a transporting container, such as a steel drum. Various materials have been employed as encapsulants including concrete, ureaformaldehyde resins, bitumen and the like. Oftentimes such encapsulation is accomplished external to the disposal vessel and the mixture, prior to hardening, is added to the disposal vessel. One particularly advantageous mode of encapsulating low-level, radio-active material is by admixing the waste and the hardenable resin in the disposal vessel. Such a procedure minimizes the nondisposable surfaces upon which the mixture of wastes and encapsulating resin may be deposited. Beneficially, such an apparatus may comprise a mixer with a selectively releasable agitator which may be raised from or lowered into a drum or other container, a container cover supported in a generally fixed relationship to the mixer, the cover having a disposable splash shield positioned generally adjacent to the container.

It would be desirable if there were a method which would minimize contamination of such a splash shield with hardenable resinous material containing radio-active waste.

It would also be desirable if there were available an improved container for use in such a disposal system.

These benefits and other advantages in accordance with the present invention are achieved in a method for the disposal of low-level radio-active wastes by encapsulation of the radio-active waste within a hardenable resin, the steps of the method comprising providing a disposable container and an agitator selectively disposable within the container and external to the container, the container having a generally open upwardly-facing end, adding to the container a pre-determined quantity of hardenable resinous material and a radio-active waste, agitating the mixture of hardenable resin and radio-active waste until the radio-active waste is encapsulated within the hardenable resin, closing the open end of the container with a container cover during the mixing process, the container cover being maintained in a generally fixed relationship to the agitator, the container cover having a disposable splash guard generally adjacent to the disposable container, subsequently removing the agitator from the container, permitting the contents of the container to harden and transporting the container to an approved disposal site, the improvement which comprises providing a generally annular membrane periphery partially closing the open end of the disposable container and permitting passage of the agitator therethrough, the membrane being deflected by and to generally conforming to the splash guard, the membrane serving to reduce the amount of resin and radio-active material splashing directly on the splash guard.

Also contemplated within the scope of the present invention is an improved container particularly suited for the disposal of low-level radio-active wastes encapsulated within a hardenable resin, the container comprising a liquid-tight body having an upwardly-facing opening, the upwardly-facing opening adapted to receive the liquid-tight closure thereon the improvement which comprises an annular membrane disposed over and adhered to a periphery of the upwardly-facing opening, the membrane being suited to prevent splashing of material onto a major portion of a splash guard through which an agitator passes when mixing material within the container.

Further features and advantages of the present invention will become more apparent from the following specification taken in connection with the drawing wherein:

FIG. 1 schematically depicts an apparatus for the practice of the method of the invention;

Figure 1:
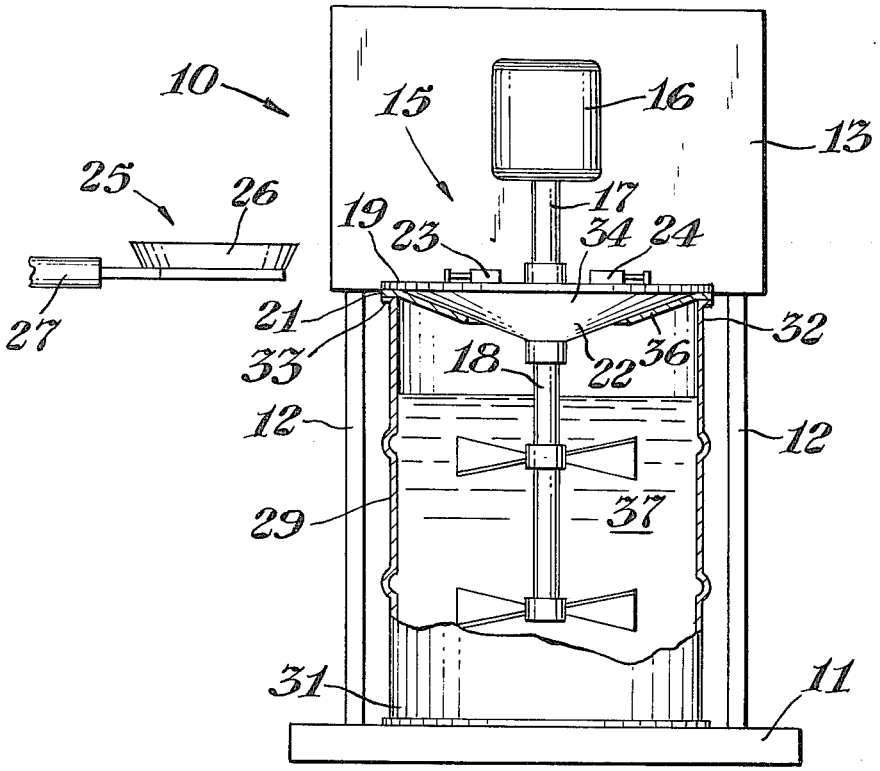
Figure 2:
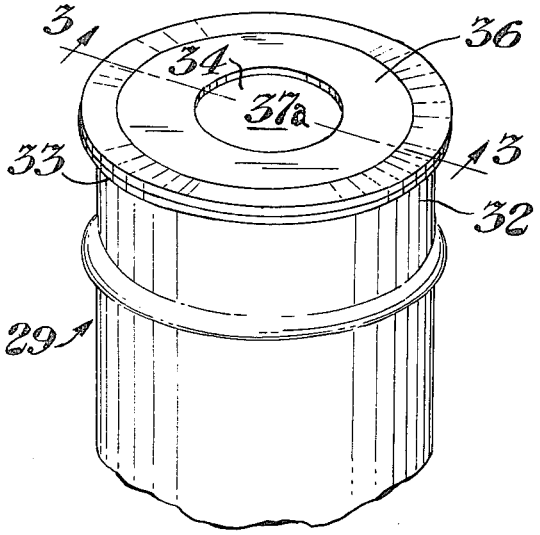
FIG. 2 is a schematic practical representation of the upper portion of a drum or container in accordance with the present invention.

In FIG. 1 there is schematically depicted an apparatus for the practice of the method of the present invention, generally designated by the reference numeral 10. The apparatus 10 comprises in cooperative combination a frame 11. The frame 11 has affixed thereto a pair of vertically extending ways 12. Slideably disposed on ways 12 is a carriage 13. The carriage 13 is depicted in FIG. 2 in its lower-most position. An agitator assembly 15 is affixed to the carriage 13. The agitator assembly 15 comprises an agitator motor or rotating means 16. The motor 16 has a downwardly-extending shaft 17 and a selectively disposable agitator 18. Also affixed to the carriage 13 is a drum or container cover or closure 19. The closure is of generally planar configuration and has a peripherally disposed downwardly-facing gasket member 21. A generally frustoconical splash guard 22 is removably affixed to the cover 19 by means of latch members 23 and 24. On the release of the latch members 23 and 24, the frustoconical splash guard 22 is permitted to fall downwardly away from the motor 16. A drip pan assembly 25 is disposed generally adjacent to cover 19. The drip pan assembly 25 comprises a drip pan 26 and a linear actuator 27 such as a pneumatic cylinder. When the carriage 13 is disposed in its uppermost portion, the linear actuator 27 is selectively extended to position the drip pan 26 beneath the agitator 18 and contain any material dripping therefrom. A disposable container 29 is positioned on the base 11 beneath the cover 19. The container 29 as depicted in FIG. 1 has the configuration of a conventional open-topped 55-gallon steel drum. The container 29 has a lower or closed end 31 and a second or upper open end 32. The upper end 32 has an outwardly flaring annular flange 33 encircling an upwardly-facing opening 34 of the container 29. A generally annular deformable membrane 36 is affixed to the flange 33 and projects inwardly into the opening 34. As depicted in FIG. 1, the membrane 36 has been deformed to a generally frustoconical configuration by the splash guard 22. As depicted in FIG. 1, a substantial portion of the radially outermost region of the splash guard at 22 is protected from contact with a material 37, such as a mixture of hardenable resin and radio-active waste disposed within the container 29 when the agitator 18 is rapidly rotated to emulsify the two components.

In FIG. 2 there is shown a fractional sectional view of the container 29 removed from the apparatus 10 to more clearly show the configuration of the annular deformable membrane 36 and its relationship to the flange 33 of the container.

As depicted in FIG. 2 the annular flange defines a generally centrally disposed opening 37 which permits a passage of the agitator 18 into or out of the container 29.

Figure 3:
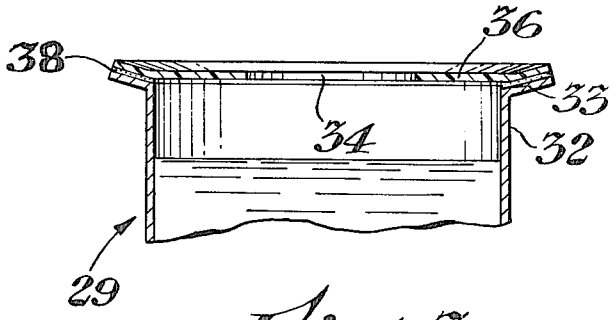
FIG. 3 is a sectional view through the container and FIG. 2 along the line 3—3 thereof.

FIG. 3 is a sectional view of the container of FIG. 2 along the line 3—3 thereof wherein an adhesive material 38 is shown annularly disposed on the flange 33 adhering the radially outermost portion of the deformable membrane 36 thereto.

A wide variety of deformable membranes such as the membrane 36 may be employed, depending upon the particular material being encapsulated and the encapsulant. For example, plastic coated crepe paper may be employed. Disposable membranes are prepared from polethylene and polyvinyl chloride having the thickness of from about ½ to 4 mils. Soft metal, such as lead foil, soft or untempered aluminum foil may also be utilized. Generally, a disc of a desired membrane such as paper of sufficient size to close the end of the drum may be applied to the flange 33 and subsequently the opening 37a formed within the membrane. Where thermoplastic film is employed, beneficially, such an opening may be cut with a hot wire such as a hair pin shaped member of 12 gauge (0.0808 inch) copper wire supported and powered by a soldering gun or alternatively annular discs may be pre-cut and subsequently adhered to the flange 33. A wide variety of pressure-sensitive adhesives may be employed, for example, a polybutadiene latex or a latex of 75 parts by weight butadiene and 25 parts by weight styrene may be employed. In general, only short-term adhesion is required, that is a length of time sufficient to mix the contents of the container to an adequate degree. The deformable membrane may be left in position or pushed into the container. In the event that it is left is position, the cover is then applied to the container and crimped over flange 33. As the contents on the container harden to a generally macro-uniform product no separate liquid phase exists and the integrity of any cover to flange 33 seal is immaterial. Containers in accordance with the present invention substantially reduce the risk of contamination of the external portion of the container by transfer or material carried on the cover such as the cover 19 of the splash seal 22.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. In a method for the disposal of low-level radioactive wastes by encapsulation of the radio-active waste within a hardenable resin, the steps of the method comprising providing a disposable container and an agitator selectively disposable within the container and external to the container, the container having a generally open upwardly-facing end, adding to the container a predetermined quantity of hardenable resinous material and radio-active waste, agitating the mixture of hardenable resin and radio-active waste until the radio-active waste is encapsulated within the hardenable resin, closing the open end of the container during the mixing process with a container cover, the container cover being maintained in a generally fixed relationship to the agitator, the container cover having a disposable splash guard generally adjacent to the disposable container, subsequently removing the agitator from the container, permitting the contents of the container to harden and transporting the container to an approved disposal site, the improvement which comprises providing a generally annular membrane partially closing the open end of the disposable container and permitting passage of the agitator therethrough, the membrane being deflected by and generally conforming to the splash guard, the membrane serving to reduce the amount of resin and radioactive material splashing directly on the splash guard.

2. The method of claim 1 wherein the container has a radially extending flange.

3. The method of claim 2 wherein the membrane is adhered to the flange with pressure-sensitive adhesive.

4. The method of claim 1 wherein the membrane is a plastic membrane.

5. An improved container suited for the disposal of low-level radio-active wastes encapsulated within a hardenable resin, the container comprising a liquid-tight body having an upwardly-facing opening, the upwardly-facing opening adapted to receive a liquid-tight closure thereon the improvement which comprises an annular deflectable membrane disposed over and adhered to a periphery of the upwardly facing opening, the membrane being suited to prevent splashing of material onto a major portion of a splash guard through which an agitator passes when mixing material within the container.

6. The container of claim 5 having a radially extending flange disposed about the opening thereof.

7. The container of claim 5 wherein the pressure sensitive adhesive adheres the membrane to the container.

8. The container of claim 5 wherein the membrane is a plastic membrane.

* * * * *

Disclaimer and Dedication 4,234,447.—*Robert A. Hay, II; Harold E. St. Louis*, both of Midland, Mich. MIXING METHOD AND CONTAINER THEREFOR. Patent dated Nov. 18, 1980. Disclaimer and Dedication filed Dec. 18, 1989, by the assignee, The Dow Chemical Company.

Hereby disclaims and dedicates to the Public all claims of said patent.

[*Official Gazette April 10, 1990* ]